US006309498B1

(12) United States Patent
Doi

(10) Patent No.: US 6,309,498 B1
(45) Date of Patent: Oct. 30, 2001

(54) SELF-CONTAINED THERMAL TRANSFER LABEL

(76) Inventor: Alfred Doi, 19471 Sierra Chula Rd., Irvine, CA (US) 92715

( * ) Notice: Subject to any disclaimer, the term of this patent is extended or adjusted under 35 U.S.C. 154(b) by 0 days.

(21) Appl. No.: 09/565,430

(22) Filed: May 5, 2000

(51) Int. Cl.[7] ..... B44C 1/00

(52) U.S. Cl. ..... 156/235; 428/40.1; 428/41.8; 428/42.1; 428/195; 428/354; 428/484; 428/913; 428/914

(58) Field of Search ..... 427/150, 152; 503/200, 201, 226; 428/195, 484, 913, 914, 40.1, 41.8, 42.1, 354; 156/235

(56) References Cited

U.S. PATENT DOCUMENTS 5,427,840 6/1995 Imamura et al. .
5,738,748 4/1998 Mitchell, Jr. .

OTHER PUBLICATIONS

AIM, Thermal "Transfer Printing", *AIM's 'Thermal Transfer Printing'*, 1993, pp. 1–7, AIM USA Copyright.
Anonymous Author, "UV Silicone and Emulsion Adhesive Tandem Coating", *North America*, Nov./Dec. 1999, pp. 44, 49.

*Primary Examiner*—Bruce H. Hess
(74) *Attorney, Agent, or Firm*—Bruce B. Brunda; Stetina Brunda Garred & Brucker

(57) ABSTRACT

A self-contained thermal transfer label is disclosed herein. The product is formed as paper stock having an area of release material applied to a surface portion thereof. A layer of adhesive material is applied upon the release material. A thermal transfer donor ribbon is mated to the label by the area of adhesive material. The donor ribbon is treated, prior to mating with the label, such that the surface tension at the donor ribbon is modified to a level substantially different from that of the release material. As a consequence, when the donor ribbon is removed from the label, after printing on the label, the adhesive remains secured to the donor ribbon, rather than the underlying label. A result is a label that may support a higher quality image, but without adhesive residue after the donor sheet is peeled away. Various applications of the product are disclosed herein.

16 Claims, 2 Drawing Sheets

SELF-CONTAINED THERMAL TRANSFER LABEL

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to SELF CONTAINED PRESSURE SENSITIVE THERMAL TRANSFER LABELS & MEDIA making. Self contained thermal transfer media can also be used as tags, tickets, receipts, fax and other digitally imaged thermally on demand.

Thermal printing has made possible cost effective digital imaging under computer control. Thermal printing makes possible one of the most accurate methods of printing machine readable bar codes. Dots printed can be overlapped producing very distinct edges needed in bar codes.

Thermal printing can be segregated into two principal categories.

Direct thermal printing functions to print an image directly on paper stock caged with heat sensitive chemicals. Because of the simplicity of the technology and cost effective in manufacturing, the population of the direct thermal printers in use today is numbered over three million world wide. Direct thermal images lack dimensional stability and resistance to physical and chemical reaction. The image thus made have problems in image stability, which gave rise to the introduction of thermal transfer printers. However, because of the higher costs of manufacturing, the population of direct thermal printers is greater than that of the thermal transfer printers. This invention is intended to allow direct thermal printers to produce images comparable to those produced by the more expensive thermal transfer printers.

Thermal printing techniques can generally be segregated into two principal categories: direct thermal printing and thermal transfer printing. Direct thermal printing functions to print an image directly on the paper stock, coated with heat sensitive material. In thermal transfer printing, a thermal transfer ribbon is applied upon the paper stock before the paper stock is passed through the thermal printer. The thermal transfer ribbon, or donor ribbon generally appears similar to carbon paper, with a wax or wax-resin coating formed on the undersurface. As the paper stock/donor ribbon is passed through the thermal printer, the print head functions to melt the wax onto the underlying paper stock in prescribed patterns. The donor ribbon is then removed from the paper stock, leaving the image formed by the thermal print head.

Thermal transfer printing has advantages that make this technology attractive. In thermal transfer printing, the ink is directly applied to the paper stock, whereas with the direct thermal transfer, no ink is used. Instead, the image arises from reaction of the heat sensitive coating as the paper stock passes adjacent the thermal print head. As a result, thermal transfer printing typically can result in a higher quality printing that resists fading and allows for long-term storage and scanability. Thermal transfer printing also lends itself to color printing, allows high graphics contrast capability and provides substantial flexibility in the papers stock or other receiving media to be printed on.

Despite the foregoing advantages, there are also disadvantages associated with thermal transfer printing. Many of those disadvantages arise from the requirement that the donor ribbon, be reliably applied in flat registry with the paper stock, then removable from the paper stock after printing. Typically, the thermal transfer ribbon is wound on a separate dispensing spool and mated to the paper stock as it reaches the thermal print head. Thereafter, the used ribbon is separated from the paper stock and rewound onto a retrieval roller. Such procedures require mechanisms that are incompatible with the large population of compact thermal printers that are currently used for many applications. Moreover, difficulties may arise in winding and rewinding the donor ribbon, wrinkling of the ribbon as it is applied to the paper, and recyclability of the donor ribbon after it is used. Disposability of the donor ribbon can be a significant problem, because many such ribbons do not readily degrade. Special treatments needed to dispose of the donor ribbon, adding cost to the labels.

In some cases, the donor ribbon is not rewound after passing through the thermal print head, but rather remains on the paper stock, and separated in use. While such techniques avoid the need for retrieving the donor ribbon, they give rise to additional difficulties resulting from adhering the donor ribbon to the paper stock. In particular, as the donor ribbon is removed from the paper stock, adhesive may remain on the paper stock causing the paper stock to be gummy, interfering with the scanability of the printed image and interfering in the ability of the paper stock to pass through dispensing mechanisms and other devices.

Accordingly, there is a need for apparatus and techniques to allow for the thermal transfer printing of labels which allows the label to be printed on conventional direct thermal printers, without the need for retrieval rollers to collect the used thermal transfer ribbon. Additionally, it is desirable that the resulting labels be cuttable to size as desired, with little or no adhesive remaining on the label after the thermal transfer ribbon is removed.

Another aspect of the present invention concerns the ability to generate secure facsimile based communications. In some cases it is desirable that communications received by facsimile are not disclosed to personnel other than the intended recipient. Use of the present invention provides for a product and technique whereby, except for the transmission cover page, only the intended recipient will review the communication. By means of the present invention, it would be readily detectible if anyone would remove donor ribbon, which is necessary to read the communication.

Accordingly, the present invention not only allows existing direct thermal printers to print higher quality documents, but also allows the documents to be communicated in a secure mode.

These and other advantages and features are achieved in the present invention as described below.

SUMMARY OF THE INVENTION

A self-contained thermal transfer label is disclosed herein. The product is formed as paper stock having an area of release material applied to a surface portion thereof. A layer of adhesive material is applied upon the release material. A thermal transfer donor ribbon is mated to the label by the area of adhesive material. The donor ribbon is treated, prior to mating with the label, such that the surface tension at the donor ribbon is modified to a level substantially different from that of the release material. As a consequence, when the donor ribbon is removed from the label, after printing on the label, the adhesive remains secured to the donor ribbon, rather than the underlying label. A result is a label that may support a higher quality image, but without adhesive residue after the donor sheet is peeled away. Various applications of the product are disclosed herein.

It is intended that the invention has an application to paper stock products, other than adhesive labels, and may be implemented as paper passing through, table mounted, or hand held direct thermal printers.

The areas of release material may be formed as strips extending transverse to the length of the label, or paper stock. The adhesive material may be formed as similarly sized, or smaller strips, extending upon the layers of adhesive material.

The donor ribbon may be for formed as a condenser paper, or as a polyester film.

The surface tension modification of the donor ribbon may be effected by means of a corona treatment applied to the ribbon before it is mated to the label/paper stock.

The invention allows for a high quality image transfer to the paper stock, and permits a secure facsimile communication using the invention.

BRIEF DESCRIPTION OF THE DRAWINGS

These, as well as other features of the present invention will become more apparent upon reference to the drawings wherein.

DETAILED DESCRIPTION OF THE PREFERRED EMBODIMENTS

The detailed description set forth below in connection with the drawings is intended as a description of the presently preferred embodiment of the invention, and is not intended to represent the only forms in which the present invention may be constructed or utilized. The description sets forth the functions and the sequence of the steps for constructing and operating the invention in connection with the illustrated embodiments. It is to be understood, that the same or equivalent functions may be accomplished by different embodiments that are also intended to be encompassed within the scope of the invention.

Reference will now be made in detail to the presently preferred embodiments of the invention, examples of which are illustrating in the accompanying drawings. Whenever possible, the same reference numbers will be used throughout the drawings to refer to the same or like parts.

The conventional peelable label formed is formed as a paper stock substrate with an adhesive layer on a first side and a release layer on the second side. The present invention supplements the conventional peelable label with a thermal transfer ribbon, or donor ribbon, coated with ink as described above. The peelable label and attached thermal transfer ribbon are fed thru a thermal printer. The ribbon is moved over the heated transfer element of the thermal printer. The ribbon is heated to cause the ink to reach a molten or fluid state. The ink transfers in its molten or fluid state to the paper stock.

The present invention is addressed to a product and production technique wherein a release layer is applied to portions or transverse strips of the paper stock, with an adhesive layer formed upon the release layer strips. The thermal transfer ribbon, or donor ribbon, is treated to enhance the surface tension of the donor ribbon, is applied to the paper stock, secured by the adhesive layer.

After cutting and printing, the donor ribbon is readily peelable from the label for use. The adhesive applied to the release layer, for securing the donor ribbon to the label, separates from the label with the donor ribbon, rather than remaining on the label. As a consequence, the label has improved surface qualities in relation to both optical scanning capacity and machine processing.

Figure 1:
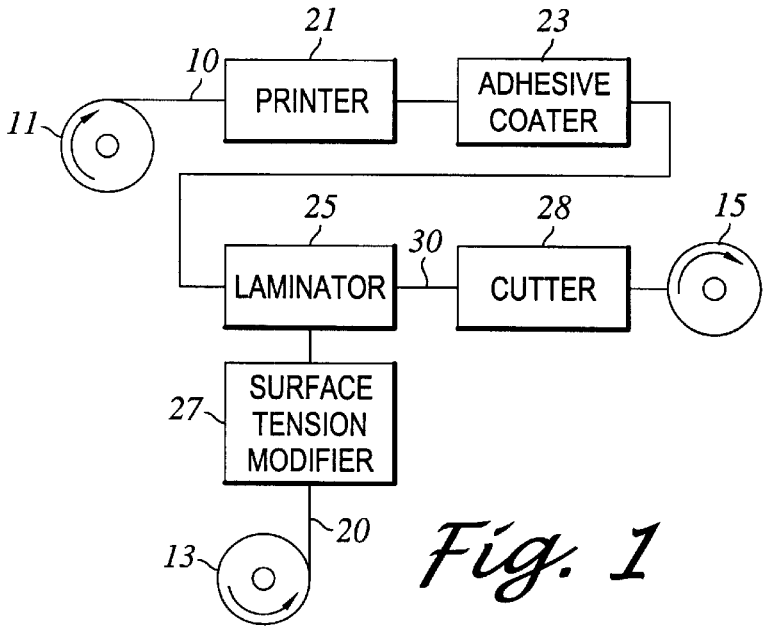
FIG. 1 is a block diagram illustrating the process for making a self-contained thermal transfer label in accordance with the present invention.

FIG. 1 illustrates a basic block diagram of one exemplary technique for forming labels in accordance with the present invention. The diagram illustrates a mating of paper stock 10 with donor ribbon 20 to form the self-contained transfer label 30. Paper stock 10 is dispensed from the paper dispensing roller 11. The paper stock 10 may at this point be formed as a continuous roll of paper stock releasably adhered to an underlying continuous roll of backing paper. The backing paper typically includes a silicon release agent to facilitate removal of the backing paper from the label.

The paper stock 10 may optionally be communicated to a printer 21, configured to provide a release coating upon the paper stock 10. In accordance with the present invention, the release coating is applied in thin strips, rather than across the entire surface of the primed paper stock. The particular size and location of the release coat layer will be selected in accordance with the paper stock being used, and other production conditions.

The printed paper stock from printer 21 is communicated to adhesive coater 23. The adhesive coater 23 preferably operates to apply a strip of adhesive coating to the paper stock to facilitate laminating with the donor ribbon 20. The adhesive layer is formed above the release coating layer and does not extend beyond the release coating to the exposed upper surface of the face stock 10. In practice, the adhesive layer may be formed as a thin band extending only a portion of the width of the release coat layer, or may be substantially co-extensive therewith.

The paper stock emerging from adhesive coater 23 is communicated to laminator 25, wherein the paper stock is mated to donor ribbon 20. Prior to mating to the paper stock, the donor ribbon 20 is communicated from dispenser roller 13 to surface tension modifier 27. In practice, the tension modifier 27 may be implemented as a corona discharge unit incorporated into the donor ribbon dispenser roller 13. The surface tension modifier 27 operates on the surface of the dispenser ribbon, i.e., upon the polymer based coating applied to the mating surface of the dispenser ribbon 20, to increase the surface energy of the donor ribbon mating surface. As a consequence, when the donor ribbon is ultimately removed from the paper stock, the adhesive coating remains on the donor ribbon, rather than on the paper stock.

In the presently preferred embodiment, surface tension of the donor ribbon is modified by applying a high frequency voltage between a pair of electrodes, and the donor ribbon passes by. As a consequence, the electrons present in the gap between electrodes accelerate, ionizing the air gap and causing electron avalanching. The polymer coatings placed in this field suffer electron impacts, breaking the molecular bonds formed on those surfaces. Oxygen can then react with free radicals formed by the ionization, producing chemical functional groups that are most effective at increasing surface energy and wetability.

The laminator 25 that receives the treated donor ribbon 20, treated to modified surface tension, and mates the treated donor ribbon to the paper stock having a release layer and an adhesive layer applied thereto. The donor ribbon and paper stock are preferably mated in substantial registry, such that the donor ribbon is applied in a manner substantially congruent with the paper stock, adhered to the paper stock by the strips of adhesive applied by adhesive coater 23. However, any lack of registering between the donor ribbon and the paper stock may be rectified by cutter 28, which trims the self-contained transfer stock.

The laminator 25 therefore outputs self-contained thermal transfer stock, which is communicated to cutter 28. The cutter 28 is preferably implemented as a rotary die cutting system which cuts self-contained thermal transfer stock into labels of required dimensions and shape. The residual area not required is stripped and may be rewound for disposal as waste. The cutter 28 then outputs a series of self-contained thermal transfer labels, on a continuous backing sheet, which are communicated to rewind roller 15.

As will be apparent to those skilled in the art, the particular size and quality of labels on a roll is determined by the printer to be used and its application. The required core size is determined in correspondence with the make and model of the thermal printer to be used.

In the presently preferred embodiment, the UV curable release coating applied by printer 21 is identified as product 15510, marketed by Northwest Coatings Corp., Oakcreek, Wisconsin 53154. The release coating includes 1 part of 100% silicone cationic curing release coating that does not require an inert atmosphere as required by conventional free radical system release coatings. The cationic release coating has the ability to cure completely, once curing is initiated, and is self-terminating. The cationic release coating has been found to be more dependable than the free radical release coatings, in which complete polymerization and cross-linking is not assured because of lack of inert atmosphere at the UV radiation source. The release coating referenced above has also been found to have a very low level of surface tension.

The adhesive applied by adhesive coater 23 is preferably an adhesive coated micro-sphere product marketed under the term GEL TAC, by Advanced Polymers, International of Syracuse, New York 13209. The micro-sphere size is in the range of 25 to 45 microns. When dried, the adhesive forms a continuous film and the only contact with the surface is at the top of the sphere, resulting in controlled tack and removability. Peel strength remains low even over time. In practice, GEL TAC product number 204D, with peel strength of 6–8 ounces per inch, at a coat weight of 6 gms as applied by flexography in a desired pattern, such as horizontal strips. As indicated above, other products and adhesive patterns may be implemented without departing from the broader aspects of the invention.

The thermal transfer ribbon, or donor ribbon generally appears similar to carbon paper or typewriter ribbon with a wax or wax resin coating formed on the undersurface. The base material of the donor ribbon must be capable of resisting the heat of the thermal head and should be thin, smooth and uniform in thickness. Good thermal conductivity is important. Most generally used are polyester film 4 to 12 micron thick or condenser paper 10 to 15 micron thick.

Polyester film is typically coated with heat resistant release coating on the side facing the thermal head. The donor side has a base release coating and specially formulated wax or wax/resin coating with proprietary additives for specific functional values. The total coating weighs about 2.5 to 5.5 gm/cm2.

The use of condenser paper, instead of polyester fiber, is favored because of the high heat resistance and uniformity in thickness. Heat resistant coating is not required because condenser paper does not melt. The condenser paper converts with ease and has structural advantages in handling and die-cutting.

A useful condenser thermal transfer ribbon coating formulation is as follows:

Base material—Condenser paper 8–12 micron thick

Coated ink weight—3–4 gr./M2

Coating method—Flexo, hot melt

| Coating formulation | |
|---|---|
| Carnuba wax | 60–70% (by weight) |
| Microcrystalline | 10–20% |
| Copolymer of polyethylene & vinyl acetate | 2–5% |
| Carbon black | 2–5% |
| Aluminum silicate | 5–10% |

Ink manufacturing method:

The above is mixed by dispersion for 60 minutes at 90–100 degrees C.

The mixed materials milled by Sand mill at 90–100 degrees C.

Physical properties of coating:

| | |
|---|---|
| Melt point | 80–85 degrees C. |
| Viscosity | 15–20 Pa's |

Whereas the polyester ribbon can be remelted, the collection of same has proven to be impractical. In land fills the polyester ribbon does not degrade and remain for a very long time.

The thermal transfer ribbon used in accordance with the present invention may be that supplied by Naigai Carbon Ink Co., of Takatsuki-Shi, Osaka 569 Japan, designated model JR-22. The base material is preferably a condensive paper, 8 microns thick with a coated weight of 2–3 grams per square meter. The thermal transfer coating formulation may be as follows:

| Product | Weight |
|---|---|
| Carnuba Wax | 60–70% by weight |
| Microcrystalene wax | 10–20% by weight |
| Copolymer of polyethylene and vinyl acetate | 2–5% by weight |
| Carbon Black | 2–5% by weight |
| Aluminum Silicate | 2–5% by weight |

As noted above, Condenser paper is the preferred material, however polyester film may also be used. A condenser paper lends itself to die cutting, with cleaner results, and can be removed after printing with ease because of its rigidity. A condenser paper will not react to extreme head built up in the thermal head, as would polyester film.

Moreover, the condenser paper lends itself more to recycling and Disposability.

Die cutting of the self-contained thermal paper stock may be effected by feeding the material between a pair of cooperating die and anvil rollers. The die roller being adapted to cut through the donor ribbon and paper stock, without cutting through the backing layer, to form individual pressure sensitive labels on a continuous backing material, which is rolled onto a core and the residue stripped and rewound as waste. The die and anvil rollers are rotatable because they lie in different vertical planes with respect to one another.

Figure 2:
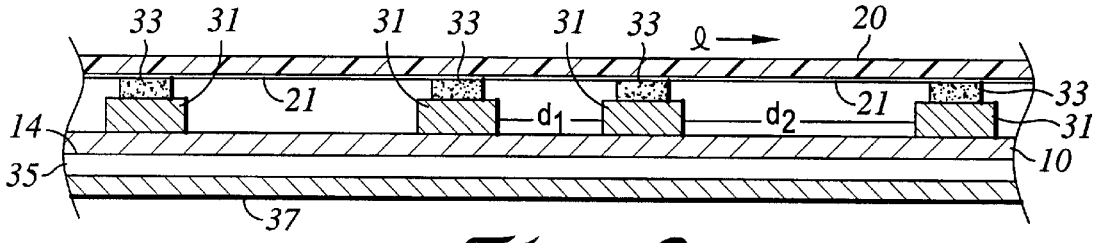
FIG. 2 is an enlarged, cross-sectional view of paper stock and applied thermal transfer ribbon, in accordance with the present invention.
Figure 3:
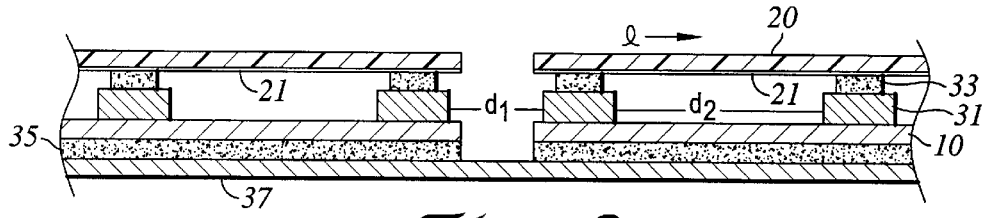
FIG. 3 is an enlarged, cross-sectional view of FIG. 2, cut to size and separate the labels.
Figure 4:
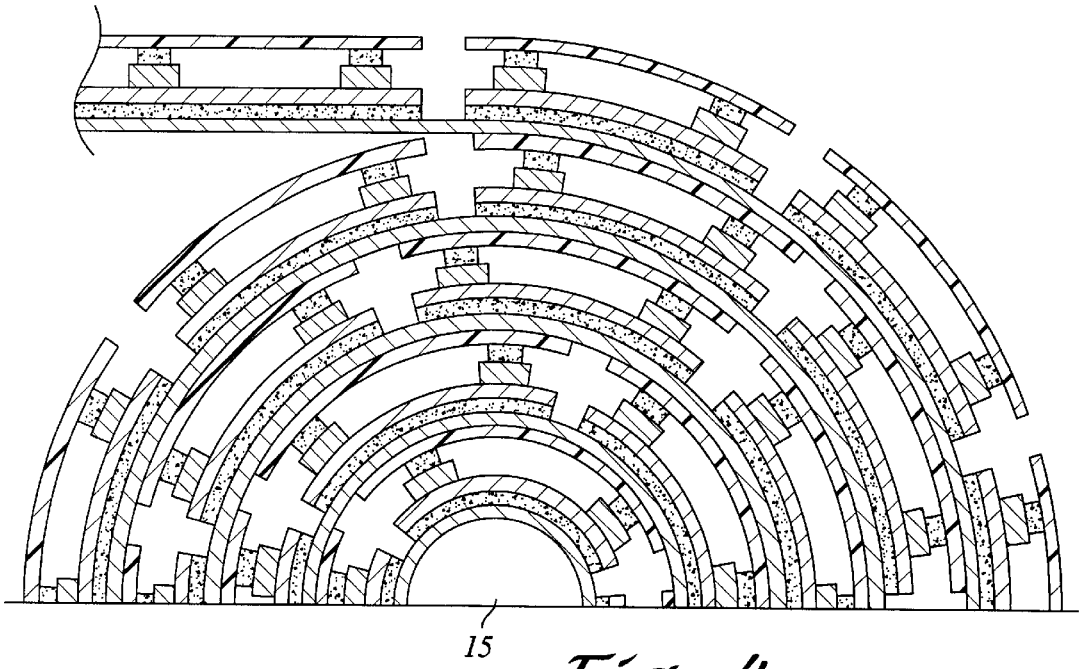
FIG. 4 is an enlarged, cross-sectional view of the cut labels of FIG. 3, being rolled onto a spool.

FIG. 2 illustrates a self-contained thermal transfer paper stock 30 emerging from laminator 25. Cutter 28 operates to cut the stock into individual labels, as illustrated in FIG. 3. The labels are then wound on rewind roller 15, as illustrated in FIG. 4.

Returning to FIG. 2, a cross-sectional view is provided of the self-contained thermal transfer stock emerging from laminator 25. As shown therein, the stock 30 includes paper stock 10, having an upper surface 12 and a lower surface 13. The upper surface 12 is provided with intermittent adhesive strips formed as described above, and separated by a predetermined distance d, selected in accordance with label and production requirements. The distance $d_1$, is the distance separating adhesive layers associated with different labels. The distance $d_2$ represents distance of separating adhesive strips associated with the same label.

Adhesive strips 33 are applied to release layers 31. As shown therein, the adhesive strips 33 may be formed as narrow strips having, a width less than the associated release layer 31, and extending transverse to the length of the paper stock 10.

The treated dispenser ribbon 20 is applied to the paper stock 10, being secured by the adhesive strips 33. As noted above, the donor ribbon 20 is treated to increase the surface tension thereof to insure that the adhesive strips 33 separate with the donor ribbon, rather than remaining upon the release strips 31, or paper stock 10.

The lower surface of paper stock 10 is provided with a continuous adhesive layer 35, which may be formed as a continuous adhesive layer, securing the paper stock to backup sheet 37.

The improvement of bonding characteristics of surfaces can be accomplished by modifying the surface tension of the surfaces involved. In order to be able to predict the location of the pressure sensitive adhesive upon separation of the surfaces bonded by pressure sensitive adhesive; the surfaces involved should be modified to result in the dramatically different surface tension possible. In the present invention a pressure sensitive adhesive is used to create a bond with a high shear strength and low peel strength. The high shear strength prevents wrinkling of the donor layer when passing through the thermal printer and resulting poor images. The low peel strength will make the separation of the donor form the receiving media easy after imaging. The surface of nonporous sheets are most cost effectively increased in surface tension by use of a corona discharge.

The wetability of the surface will improve the bond of the adhesive to a surface that is treated. The surface energy of that surface so treated is measured in dynes per centimeter. The surface energy of the donor ribbon or sheet should be higher than that of the receiving media to insure the placement of the pressure sensitive adhesive will remain on the donor when delaminating from the receiving media upon completion of imaging.

Corona treating system has been used to increase the surface energy of the donor. The system consists of two major components:

1. power supply
2. treater station

The power supply uses standard 50/60 Hz power and converts it into single phase, high frequency (10 to kHz) power that is supplied to the treater station.

The treater station applies this power to the surface of the material, through an air gap, via pair of electrodes, one at the high potential and the other, usually a roll which supports the material, at ground potential. Only the side of the material facing the high potential electrode show an increase in surface tension. The voltage buildup ionizes the air in the air gap, creating a corona, which will increase the surface tensions of the substrate passing over the electrically grounded roll.

FIG. 3 illustrates the same composite construction as set forth in FIG. 2, as it emerges from cutter 28. As shown in FIG. 3, cutter 28 operates to cut away portions of the donor sheet 20, paper stock 10 and adhesive layer 35 leaving only the backup sheet 37. As such, the paper stock is separated into individual labels which can be separately peeled from the backup sheet 37.

FIG. 4 illustrates collection of self-contained thermal transfer layers, as shown at FIG. 3, collected upon rewind roller 15. As noted above, the size and quantity of labels collected upon rewind roller 15 will vary in accordance with particular applications. Similarly, alternate collection procedures/devices may be utilized in place of rewind roller 15.

The product collected on rewind roller 15 may thereafter be inserted within or adjacent a commercially available direct thermal printer, for use by the direct thermal printer. As the product passes through the thermal printer, an image is printed upon the paper stock 10, by melting the wax or wax resin coating formed on the lower surface 21 of the donor ribbon 20. After printing, the donor ribbon may be peeled from the labels and disposed of through recycling or other means.

It is anticipated that the present invention may be useful, not only in office facsimile machines, but also in the various types of thermal printers, such as those utilized by those rental car return attendants, ticket vendors and many others.

As noted above, an additional feature of the present invention relates to its use to facilitate secure communications through facsimile machines. A common disadvantage of such conventional machines is that anyone about the fax machine may read the substance of the communication as it is received. or forwarded to the intended recipient. Where, for example, sensitive or personal communications are being forwarded, recipient may request advance notice of such transmission so that they can personally attend the receiving facsimile machine as the message is received and insure that a distribution of the communication does not occur. The result is a cumbersome, inefficient, and often times a frustrated effort. The present invention provides an apparatus and technique which may alleviate those difficulties.

The present invention results in facsimile of a composite product with the message on the paper stock completely covered by the overlying donor ribbon. The message is not readable from simply looking at the composite product. Rather, once the donor ribbon is peeled from the paper stock, the letter or images formed by the donor ribbon are peeled from the donor ribbon as they remain on the paper stock. The donor ribbon therefore appears as a negative of the image of the message readable by examination of either the donor ribbon, or the paper stock.

For anyone to read the message on the product, that person must peel the donor ribbon from the paper stock. The evidence that such peeling has occurred is plainly apparent from inspection of the donor ribbon, i.e., can the message be seen through the donor ribbon? If the donor ribbon remains applied to the paper stock, without any message readable therethrough, the recipient can conclude that the message has not been read by anyone prior to it reaching that person.

In order to assure that a message is sent to a proper recipient in the first place, there must be some technique for determining who the message is directed to. One practical technique identifying the intended recipient is to peel the donor ribbon from only the first sheet of the received communication, which typically is a transmittal sheet identifying the intended recipient, as well as the number of pages in the transmission. An attendant can therefore peel the first sheet to identify the intended recipient, and then collect the remaining pages and deliver them to that intended recipient, with the donor ribbon remaining on the paper stock. Of course, it is expected that other techniques for identifying the intended recipient may be apparent to those of ordinary skill in the art. Similarly, as one of ordinary skill in the art will recognize, the present invention may be modified or implemented in conjunction with other production techniques, or materials, without departing from the broader aspects of the invention, as set forth in the claims appended hereto.

What is claimed is:

1. A self-contained thermal transfer paper, the paper comprising:

a) a paper stock having upper and lower surfaces and a first edge portion;

b) a first area of release material disposed on the paper stock upper surface, the release material being formed as a strip extending transverse to the length of the paper stock, adjacent the first edge portion thereof;

c) a first area of adhesive material disposed upon the first area of release material; and d) a thermal transfer donor ribbon disposed upon the paper stock upper surface, in substantial registry therewith, the donor ribbon having a thermal transfer coating formed on the side facing the paper stock, the thermal transfer coating having a surface tension greater than the surface tension of the release material.

2. The paper as recited in claim 1 further comprising:

a) a second area of adhesive disposed on the paper stock lower surface; and b) a backing sheet extending along the second layer of adhesive material, and releasably adhered thereto.

3. The paper as recited in claim 1 further comprising a second area of release material disposed on the paper stock upper surface in spaced parallel relation to the first area of release material.

4. The paper as recited in claim 3 wherein the paper further includes a second edge portion, and wherein the first area of release material is formed substantially adjacent the first edge portion, and said second area of release material is formed substantially adjacent the second edge portion.

5. The paper as recited in claim 1 wherein the donor ribbon is formed of paper material.

6. The paper as recited in claim 1 wherein the donor ribbon is formed of plastic material.

7. The paper as recited in claim 1 wherein the first area of adhesive material is formed as a strip narrower than the first area of release material.

8. A roll of printable labels adhesively disposed on a continuous backing sheet and suitable for printing in a thermal printer, the roll comprising:

a) a plurality of labels disposed along the backing sheet, each label having upper and lower surfaces and a first edge portion, the label lower surface having a first area of adhesive material disposed thereon for securing the label to the backing sheet;

b) a first area of release material disposed on each label upper surface, the first area of release material being formed as a strip extending transverse to the length of the label adjacent the first edge portion thereof, c) a first area of adhesive material disposed upon each first area of release material;

d) a thermal transfer donor ribbon disposed adjacent the label upper surface, upon the first area of adhesive material, the donor ribbon having a thermal transfer coating formed on the side facing the labels, the coating having a surface tension greater than the surface tension of the release material.

9. The roll as recited in claim 8 further comprising a second area of release material disposed on the label in spaced parallel relation to the first area of release material.

10. The roll as recited in claim 9 wherein the label further includes a second edge portion, and wherein the first area of release material is formed substantially adjacent the label first edge portion, and said second area of release material is formed substantially adjacent the label second edge portion.

11. The roll as recited in claim 8 wherein the donor ribbon is formed of paper material.

12. The roll as recited in claim 8 wherein the donor ribbon is formed of plastic material.

13. The roll as recited in claim 8 wherein the second area of adhesive material is formed as a strip narrower than the first area of release material.

14. A process of fabricating a self-contained transfer label comprising:

a) applying strips of release material upon paper stock adhesively mounted to a backing layer, the release material being disposed substantially transverse to the length of the paper stock;

b) applying a first area of adhesive upon each strip of release material;

c) dispensing a donor ribbon having a thermal transfer coating formed on the side facing the paper stock;

d) treating the donor ribbon such that the surface tension thereof is greater than the surface tension of the release material;

e) forming the treated thermal transfer donor ribbon to the paper stock such that the donor ribbon extends in substantial registry with the paper stock, the donor ribbon being adhered to and supported by the first area of adhesive; and f) cutting the donor ribbon and paper stock to define individual labels each label being peelably adhered to the backing sheet.

15. A method of printing a thermal transfer image on a direct thermal image printer, comprising;

a) feeding the self-contained paper stock of claim 1 into a direct thermal printer;

b) printing the paper stock by thermal transfer from the donor ribbon to the paper stock; and c) simultaneously removing the donor ribbon and underlying adhesive from the paper stock, to expose the thermal transfer image thereon;

d) whereby the image is transferred from the donor ribbon to the paper stock when the donor ribbon is peeled, and the fact that the donor ribbon has been peeled is evident from the negative of the image formed on the donor ribbon after peeling.

16. A method of securely printing messages on paper stock such that viewing of the message by anyone other than the intended recipient can be readily detected, the method comprising:

a) feeding the self-contained paper stock of claim 1 into a direct thermal printer;

b) printing the paper stock by thermal transfer from the donor ribbon to the paper stock; and c) simultaneously removing the donor ribbon and underlying adhesive from the paper stock, to expose the thermal transfer image thereon.

d) whereby the image is transferred from the donor ribbon to the paper stock when the donor ribbon is peeled, and the fact that the donor ribbon has been peeled is evident from the negative of the image formed on the donor ribbon after peeling.

* * * * *